United States Patent [19]

Riba

[11] Patent Number: 5,018,371

[45] Date of Patent: May 28, 1991

[54] TUNNEL FINISHER

[76] Inventor: Günther Riba, Mühlental 78, D-5400 Koblenz 1, Fed. Rep. of Germany

[21] Appl. No.: 458,680

[22] PCT Filed: May 30, 1989

[86] PCT No.: PCT/EP89/00603

§ 371 Date: Jan. 29, 1990

§ 102(e) Date: Jan. 29, 1990

[87] PCT Pub. No.: WO89/12134

PCT Pub. Date: Dec. 14, 1989

[30] Foreign Application Priority Data

May 30, 1988 [DE] Fed. Rep. of Germany ... 3818387[U]
Mar. 22, 1989 [DE] Fed. Rep. of Germany ..... 8903655

[51] Int. Cl.[5] ..... D06F 61/06

[52] U.S. Cl. ..... 68/5 C; 34/216; 68/5 E; 223/51

[58] Field of Search ..... 68/5 C, 5 D, 5 E; 38/1 A, 1 C, 7, 8, 9, 14, 44, 49; 223/51, 52, 70, 73, 76; 34/151, 210, 212, 216

[56] References Cited

U.S. PATENT DOCUMENTS 2,911,729 11/1959 Wood .
3,765,580 10/1973 Wilsker et al. ..... 68/5 D X
4,823,488 4/1989 Fottner ..... 68/5 C X

FOREIGN PATENT DOCUMENTS 3119560 12/1982 Fed. Rep. of Germany ..... 223/51
3119664 12/1982 Fed. Rep. of Germany ..... 223/51
3119618 1/1983 Fed. Rep. of Germany ..... 223/51
3519567 9/1986 Fed. Rep. of Germany .
3519568 10/1986 Fed. Rep. of Germany .
3710674 4/1988 Fed. Rep. of Germany .
2072494 9/1971 France .
2262710 9/1975 France .
WO88/10333 12/1988 PCT Int'l Appl. .

*Primary Examiner*—Philip R. Coe
*Attorney, Agent, or Firm*—Donald Brown; David S. Resnick

[57] ABSTRACT

A tunnel finisher is provided with an entrance and an outlet and respective pairs of air drums associated to the entrance and the outlet. The tunnel finisher comprises a conveyer with grippers for passing a garment to be treated through the tunnel finisher, a steam supply at the inner side of the inlet pair of air drums and close thereto, a recirculation apparatus for the atmosphere and a supply of air into the interior of the air drums. The conventional separation between the steam chamber and the finishing chamber is omitted by providing a detector actuated by a garment to be finished and controlling the cross-section of the air outlet of the recirculation apparatus.

12 Claims, 3 Drawing Sheets

FIG. 1
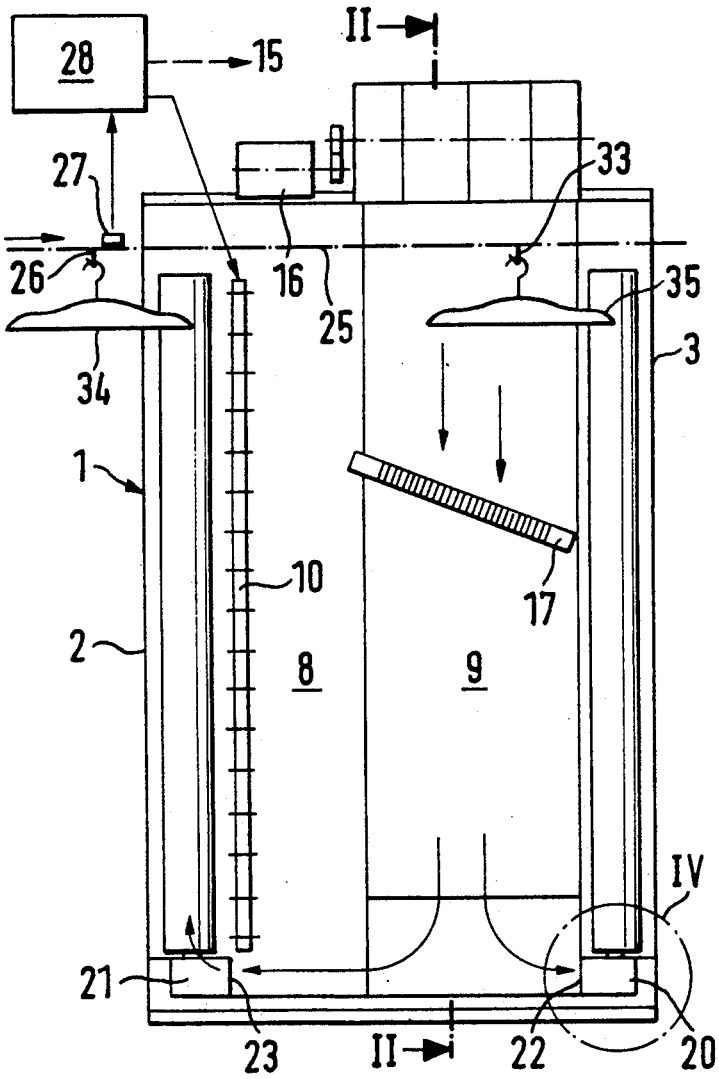
FIG. 2
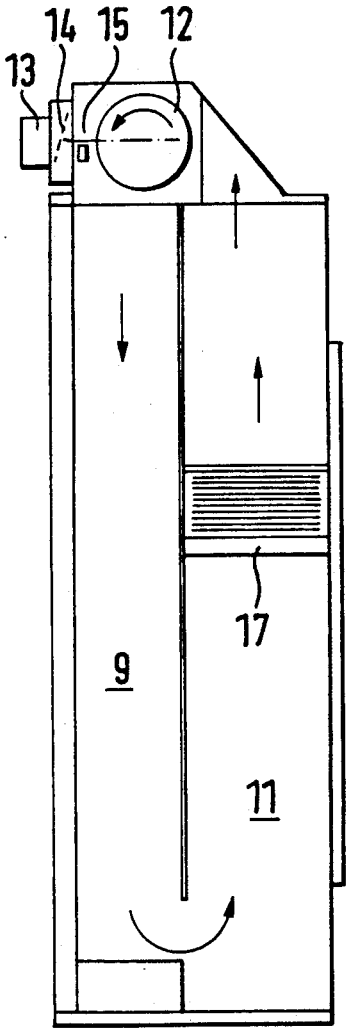
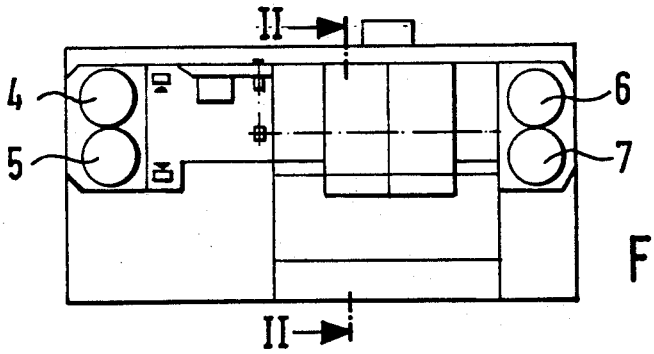
FIG. 3

TUNNEL FINISHER

The invention relates to a tunnel finisher.

A tunnel finisher of this kind is disclosed in the DE-PS No. 35 19 568. This tunnel finisher comprises a steam chamber separated from a finishing chamber by air drums. An exhaust chamber passes off from the ceiling of the steam chamber.

It is the object of the invention to provide a tunnel finisher of the above described kind which is particularly compact in size and has a low steam consumption.

The conventional separation between the steam chamber and the usual finishing chamber by means of the air drums can be omitted by exhausting the steam in the same direction as the air stream in the finishing chamber, i.e. downwards, and thereafter passing the same together with the air stream to an exit.

Hence, the air stream in the finishing chamber forms virtually a bulk head and prevents the steam from entering into the finishing chamber. The steam is then removed in concentrated form already in the first circulating cycle through the exit to a great extent. When the steam is conventionally exhausted upwardly into a separate exit chamber, the steam having a natural upwardly rising tendency which is supported by the suction will cause a swirl opposite to the direction of the air stream and will additionally suck air from the finshing chamber.

There is the following further advantage of the downward steam exhaust which again has a positive effect on the steam consumption: a kind of rubber band effect is created. The exiting steam strives upwardly, but is simultaneously pulled downwardly. Thereby a uniform distribution over all finishing goods is achieved. In the reversed situation considerably more steam must be used in order to provide sufficient supply to the lower parts, even by means of additional nozzles on the floor.

Further features and advantages of the invention will be apparent from the description of an embodiment with reference to the drawings. In the drawings:

FIG. 1 is a lateral view of a tunnel finisher having the front plate removed;

FIG. 2 is a sectional view along line II—II in FIG. 1 or FIG. 3, resp., of the tunnel finisher shown in FIG. 1 with partly removed cover;

FIG. 3 is a top view of the tunnel finisher;

Figure 4:
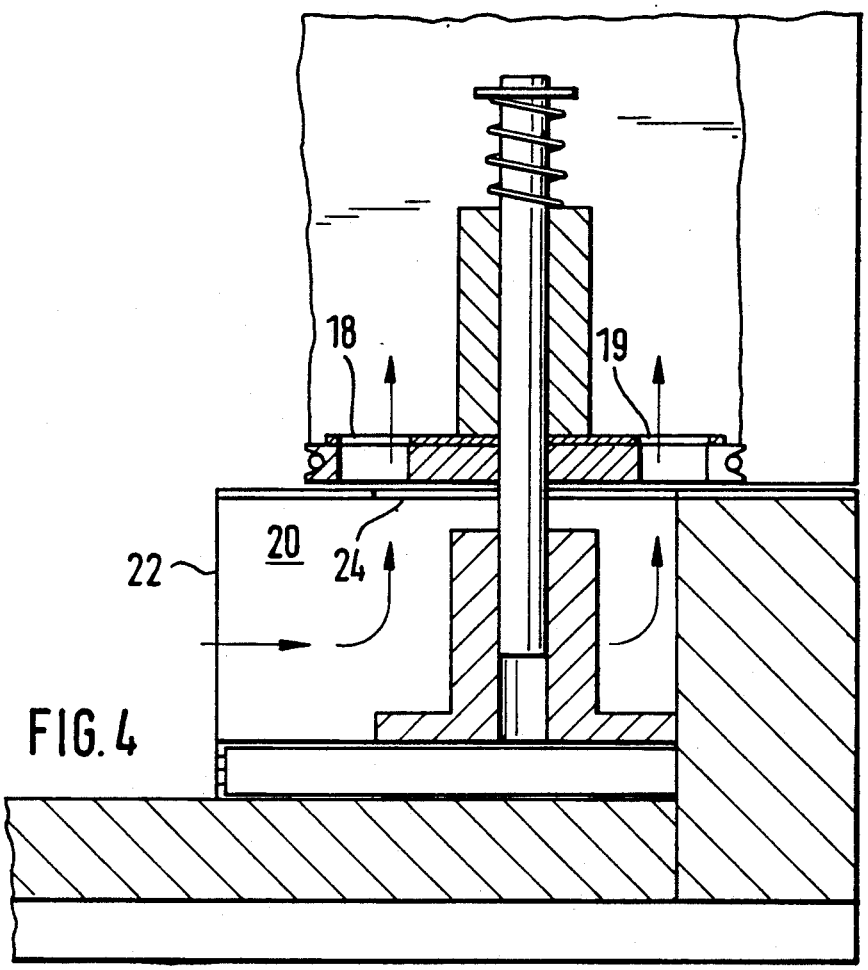
FIG. 4 is an enlarged representation of the bottom end of an air drum and of the associated air supply channel according to the circle IV in FIG. 1.

The tunnel finisher comprises a housing 1 with an entrance 2 and an exit 3. The entrance 2 is closed by means of an inlet side pair of air drums 4, 5 and the exit is closed by means of an outlet side pair of air drums 6, 7 in such a manner that a garment to be treated may be passed therethrough, but steam is prevented from exiting outwardly from the interior of the chamber.

The interior of the chamber consists of a first portion, the steam chamber 8, at the entrance side and a subsequent outlet side portion, the circulation chamber 9. A steam nozzle arrangement 10 extending along the total height of the chamber is provided at the inner side of the inlet air drums and in a small distance therefrom. Steam can be supplied into the interior of the steam chamber through the steam nozzle arrangement.

As may be best seen from the FIGS. 1 and 2, the circulation chamber 9 has the bottom end thereof connected to a recirculation channel 11 which leads to the suction side of a circulation arrangement 12. The circulation arrangement 12 which is driven by a drive motor 16 has the outlet thereof connected with the upper side of the circulation chamber 9. Additionally a control flap 14 is provided which leads to an exit opening 13 and can be shifted between a closed position and an open position by means of a lift magnet 15 and a lever system connected with the flap. Within the recirculation channel 11 there is a heating installation 17 which is passed by the air to be recirculated and exerts some resistance on the air flow such that a certain back pressure is generated at the bottom inlet of the recirculation channel 11.

As indicated in FIG. 1 and shown in detail in FIG. 4 the air drums 4 to 7 have entrance openings 18, 19 at the bottom side thereof. A respective air supply channel 20, 21 is provided immediately below each air drum. The air supply channels are connected at the inlet thereof to the steam chamber 8 or the circulation chamber, resp., through apertures 22, 23. The air supply channels have openings 24 at the outlet side thereof which are positioned immediately below the entrance openings 18, 19 of the air drums traveling thereabove. Air is supplied from the interior of the chamber into the air drums through this passage.

In conventional manner conveyer means is provided having a circulating chain 25 with grippers 26 hanging therefrom. The chain circulates such that the pressing goods to be processed enter at the inlet side between the drums 4, 5 and exit at the outlet side between the drums 6, 7. A proximity switch or limit switch, resp., 27 is provided at the inlet side, which is activated whenever the pressing goods to be processed have been just brought by the gripper into the position shown in FIG. 1 in which the goods enter in-between the two inlet air drums 4, 5.

A control unit 28 is provided which has the inlet thereof connected to the limit switch 27 and the outlet thereof connected to the lift magnet 15 for controlling the opening position of the control flap 14 and for switching on and off, resp., the steam supply 10.

Figure 5:
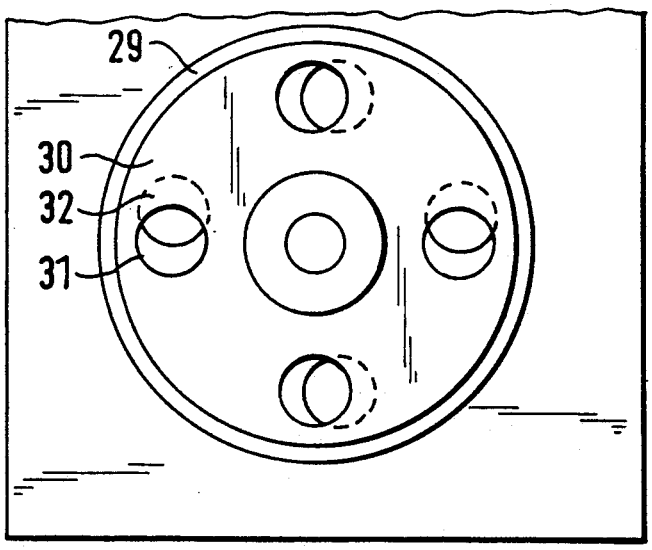
FIG. 5 is a top view showing a detail of the air entrance side of the air drums.

As may be seen from FIG. 5, the bottom side of the air drums may comprise two coaxial disks 29, 30 being rotatable with respect to each other and having aligned bores 31, 32. The cross-section of the resulting apertures can be adjusted by rotating one disk with respect to the other. It is further possible to provide such means for adjustment of the cross-section in the respective air supply channel.

Preferably the cross-section of the air supply channels 18, 19 and also of the entrance opening 24 for passing air for the outlet air drums 6, 7 is smaller than the one of the inlet air drums 4, 5.

The distance between two consecutive grippers 26, 33 is selected such that a second garment 34 which is indicated by a hanger in FIG. 1 enters between the air drums at the inlet side at the time when the fist garment 35 which is also indicated by a hanger enters between the outlet pair of air drums.

In operation a signal is fed from the limit switch 27 to the control unit 28 as soon as the second garment 34 enters between the inlet pair of air drums. The control unit 28 starts the steam supply into the steam chamber 8 through the steam nozzle arrangement. The steam nozzles remain open in a time controlled manner until the garment has passed the steam nozzles and the tension within the material is sufficiently relaxed for the pressing operation.

The garment then enters the circulation chamber 9. It is here fulled or pressed, resp., and dried by the heated circulating stream before it leaves between the pair of air drums 6, 7.

Simultaneously with the activation of the steam nozzles the control unit 28 effects that the control flap 14 is brought into its open position by means of the lift magnet 15 such that up to about 20% of the circulating air is passed outwardly through the exit opening 13. The air is removed in about the same relation as the steam supply through the steam nozzle arrangement 10. Steam which did not condense in the garment is thereby eliminated from the circulating air. The control circuit is designed such that after switching off the steam supply the control flap 14 is closed in a time-delayed manner such that the residual steam can leave the chamber as far as possible. When the second garment enters the circulation chamber 9, the control flap is again closed and the complete air stream causes the pressing or ironing effect.

The air stream exiting from the circulation chamber 9 into the recirculation channel 11 is, to some extent, decelerated by the flow resistance of the heating installation and a certain back pressure is generated at the bottom end of the channel 11; as a consequence, air enters the air drums through the channels 20, 21. As indicated above, the control flap 14 is opened whenever the second garment enters between the inlet air drums and hence, the first garment enters between the outlet air drums. By opening the control flap 14 air is removed and therefore the internal pressure and thus also the back pressure is lowered. As a consequence, the internal pressure in the air drums drops such that the already treated garment is not deformed when passing through the outlet air drums. Following from the fact that the air passage section of the inlet air drums is larger than the one for the outlet air drums, the former receive more air within their interior and therefore have a stronger closing action than the outlet air drums.

Figure 6:
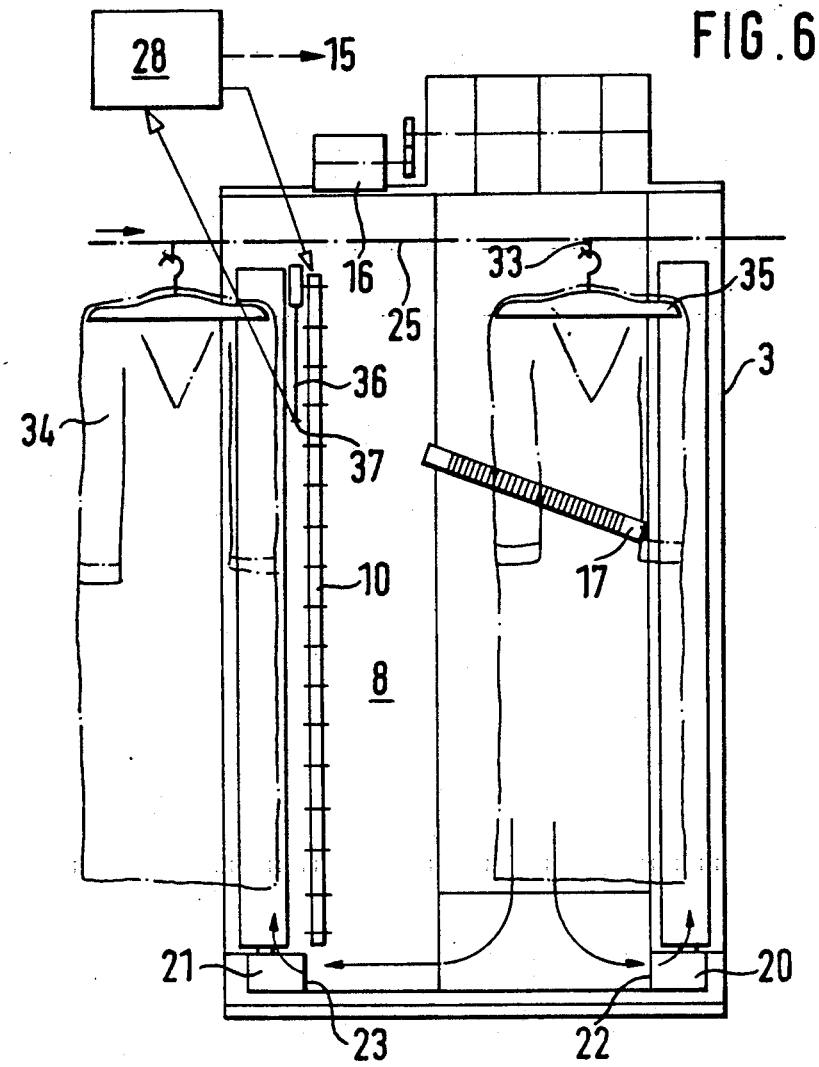
FIG. 6 is a lateral view of a further embodiment of a tunnel finisher.
Figure 7:
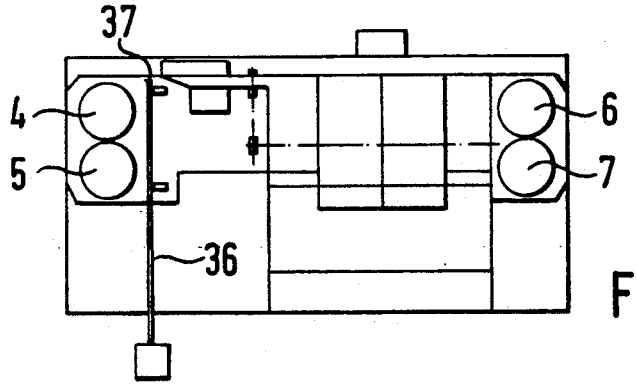
FIG. 7 is a top view of the tunnel finisher shown in FIG. 6.

In the second embodiment shown in the FIGS. 6 and 7 the limit switch 27 is replaced by a detector 36 which is formed as a light barrier and which is disposed in traveling direction immediately ahead of the steam nozzle arrangement 10. The light source is arranged on one side of the channel and the light detector 37 is arranged on the opposite side of the channel. The detector is disposed a few millimeters ahead of the steam nozzles. The outlet thereof is connected to the control unit 28. The control unit 28 is designed such that the steam supply is activated as long as the detector detects the passage of a particular good to be treated. It is achieved in this manner that the steam supply is switched on only during the passage of a product to be treated, independently of the operating speed and of the width of the product to be treated, and hence, only the minimal amount of steam required is supplied.

All remaining features of this tunnel finisher are identical with those of the first embodiment. Steam does no longer act upon the exiting garment in the rear portion of the tunnel, because the steam is evacuated in the region which is directly behind the steam nozzles and the steam is partly removed through the exit opening 13. Thus, a continuous finishing operation is achieved.

I claim:

1. A tunnel finisher comprising an entrance and an exit, a pair of air drums within the tunnel finisher and associated with the entrance and a further pair of air drums within the tunnel finisher and associated with the exit, a steam chamber and a circulation chamber within the tunnel finisher, conveyor means having grippers for passing garments into the tunnel finisher between the entrance pair of air drums, through the steam and circulation chambers, and out of the tunnel finisher between the exit pair of air drums, a steam supply means within the steam chamber and adjacent the entrance pair of air drums, a recirculation means associated with the circulation chamber for recirculating an atmosphere within the tunnel finisher, a detector for indicating that a garment to be treated passes the steam supply means, the recirculation means having an air outlet with variable cross-section, a control connecting the detector and the air outlet for adjusting the cross-section of the air outlet and for activating the steam supply whereby the control is designed such that during steam supply the cross-section is adjusted such that part of the steam is passed to the outside of the tunnel finisher through the recirculation means.

2. Tunnel finisher according to claim 1, wherein the recirculation means includes a channel which leads to an air outlet and which has an inlet in the lower portion of the steam chamber or circulation chamber.

3. Tunnel finisher according to claim 2, further including a heating installation in the recirculation channel.

4. Tunnel finisher according to claim 1, wherein the control is designed such the air outlet is closed whenever the steam supply is switched off.

5. Tunnel finisher according to claim 1, further including a control which lowers an air supply into the interior of the outlet pair of air drums during the passage of a first garment.

6. Tunnel finisher according to calim 1, wherein the distance between two grippers is selected such that a second garment enters at the inlet when a first garment enters between the exit pair of air drums.

7. Tunnel finisher according to claim 1, wherein the control is designed such that the steam supply is switched on only as long as the detector detects a garment ahead of the steam supply means.

8. Tunnel finisher according to claim 7, wherein the detector is disposed in traveling direction immediately ahead of the steam supply means.

9. Tunnel finisher according to claim 7 or 8, wherein the detector is formed as a light barrier.

10. Tunnel finisher according to claim 1, wherein the control is designed such that the air outlet remains open for a short time after switching off the steam supply.

11. Tunnel finisher according to claim 1, further including air supply channels connecting the interior of the chambers to the air drums provided below said air drums.

12. Tunnel finisher according to claim 11, wherein the cross-section of the air supply channels and inlet opening leading to the exit pair of air drums is smaller than the cross-section of the channels and inlet opening leading to the entrance pair of air drums.

* * * * *